US005970923A

United States Patent [19]

Nakashima

[11] Patent Number: 5,970,923

[45] Date of Patent: Oct. 26, 1999

[54] TANK STRUCTURE FOR HOT-WATER SUPPLY UNIT

[75] Inventor: Akira Nakashima, Aichi-ken, Japan

[73] Assignee: Toyotomi Co., Ltd., Nagoya, Japan

[21] Appl. No.: 09/141,336

[22] Filed: Aug. 27, 1998

[30] Foreign Application Priority Data

Aug. 29, 1997 [JP] Japan ..... 9-250020

[51] Int. Cl.[6] ..... F22B 37/36

[52] U.S. Cl. ..... 122/494; 122/13.1; 122/14; 122/17; 122/367.1

[58] Field of Search ..... 122/13.1, 14, 17, 122/367.1, 367.2, 367.3, 494

[56] References Cited

U.S. PATENT DOCUMENTS

| | | | |
|---|---|---|---|
| 1,300,873 | 4/1919 | Quinn | 122/17 |
| 5,228,413 | 7/1993 | Tam | 122/17 |

FOREIGN PATENT DOCUMENTS

| | | |
|---|---|---|
| 57-58530 | of 1982 | Japan . |
| 61-7463 | of 1986 | Japan . |
| 63-8382 | of 1988 | Japan . |
| 4-28977 | of 1992 | Japan . |
| 4-63933 | of 1992 | Japan . |

*Primary Examiner*—Teresa Walberg
*Assistant Examiner*—Jiping Lu
*Attorney, Agent, or Firm*—Pollock, Vande Sande & Amernick, R.L.L.P.

[57] ABSTRACT

A tank structure of a hot-water supply unit capable of permitting tap water under a high pressure to be supplied thereto without using any safety mechanism. An inner barrel of a tank body is formed by rounding or bending a flat plate of an increased thickness by rolling and then joining both lateral ends of the plate to each other by welding. The inner barrel and an outer barrel are joined together through a joint ring of a thickness between a thickness of the inner barrel and that of the outer barrel. Thus, the tank body can be readily manufactured using any specific equipment.

3 Claims, 2 Drawing Sheets

TANK STRUCTURE FOR HOT-WATER SUPPLY UNIT

BACKGROUND OF THE INVENTION

This invention relates to a tank structure for a hot-water supply unit, and more particularly to a tank structure for a hot-water supply unit suitable for use in a hot-water supply system or a hot-water space heating system which is simply installed and keeps a temperature of hot water stable.

In general, a conventional hot-water supply unit proposed for simple installation is constructed into a pressure direct-application structure wherein a metal piping is wound around a combustion chamber to constitute a heat exchange section, to thereby feed tap water directly to the metal piping for heating. Such construction of the conventional hot-water supply unit permits tap water under a high pressure to be directly supplied thereto, to thereby highly simplify a piping structure, because the heat exchange section is constituted by the metal piping exhibiting highly increased pressure resistant characteristics. Also, it has another advantage of extensively facilitating installation of the unit.

Thermal transfer to the metal piping in the conventional hot-water supply unit is carried out by heating a metal wall of a combustion chamber and then transferring heat of the combustion chamber to the metal piping to heat it, resulting in thermal efficiency being highly deteriorated. It would be considered to increase a length of the metal piping, to thereby increase a heat transfer area of the piping. However, this causes water fed to the piping to be boiled at portions of the piping locally excessively heated, resulting in whole heat efficiency of the piping being conversely deteriorated. Thus, the conventional hot-water supply unit substantially fails to increase heat efficiency. Also, it renders temperature control of hot water highly troublesome because tap water fed to the metal piping is heated during passage thereof through the metal piping.

Another hot-water supply unit is also proposed. The unit proposed includes a tank body of a double-barrel structure constituted of an inner barrel arranged around a combustion chamber and an outer barrel arranged outside the inner barrel. Water is fed to the tank body and heated therein, followed by discharge of the heated water through a hot-water discharge pipe. In order to increase heat exchange efficiency of the tank body, the inner barrel has a height smaller than that of the outer barrel and a plurality of connection pipes are arranged between an inner barrel top plate and an outer barrel top plate to heat water outside the connection pipes. However, the tank body causes a configuration thereof to be complicated with an increase in heat exchange area thereof, leading to a deterioration in pressure-resistant characteristics thereof. Thus, the unit fails to feed tap water under a high pressure to the tank body, so that it is required to arrange a safety mechanism such as a pressure reducing valve, a safety valve or the like in the piping to prevent breakage of the tank body.

The hot-water supply unit permits the amount of water stored in the tank body of the double-barrel structure to be increased and a heat transfer area to be readily increased with an increase in length of the connection tubes and the number thereof, resulting in highly increasing heat exchange efficiency. Also, an increase in the amount of water stored in the tank body ensures constant and stable feeding of hot water and minimizes a variation in temperature of hot water in use, when a temperature in the tank body is kept at a predetermined level by heating.

However, the hot-water supply unit of the double-barrel structure is restricted to operation at a water pressure as low as at most about 5 kgf/m$^2$ because the tank body is complicated in structure. Thus, it fails in operation at a water pressure as high as 21 kgf/m$^2$ as applied to the above-described unit of the metal piping type which is connected directly to a water service pipe. Thus, it necessarily requires arrangement of a pressure reducing valve for reducing a water pressure to a level of 1 kgf/m$^2$ or a safety device for relieving an excessive pressure applied to the tank body. Also, it requires arrangement of a drainage pipe for drainage when an excessive pressure is applied thereto. Such situation causes a piping around the tank body to be highly complicated.

It would considered that an increase in thickness of a plate material for the tank body leads to an increase in pressure resistance thereof even when the tank body is complicated in structure. However, an equipment for bending or curving a plate material increased in thickness into components of the tank body must be constructed in a specific manner, leading to an increase in cost and lack of universality, so that an investment in the equipment is wasted. Thus, actually, the tank body thus increased in thickness has not been available. Also, such an increase in thickness of the tank body causes an increase in weight of the tank body, resulting in installation of the unit being highly troublesome. Thus, the hot-water supply unit including the tank body of the double-barrel structure has not been put to practice from the viewpoints of both manufacturing and installation.

SUMMARY OF THE INVENTION

The present invention has been made in view of the foregoing disadvantage of the prior art.

Accordingly, it is an object of the present invention to provide a tank structure for a hot-water supply unit which is capable of permitting tap water under a high pressure to be supplied thereto without using any safety mechanism.

In accordance with the present invention, a tank structure for a hot-water supply unit is provided. The tank structure includes an inner barrel arranged so as to define a side wall of a combustion chamber and an outer barrel arranged outside the inner barrel so as to be spaced from the inner barrel at a predetermined interval. The inner barrel and outer barrel cooperate with each other to constitute a tank body of a double-barrel structure. The tank structure also includes an inner top plate mounted on an upper portion of the inner barrel so as to close the upper portion of the inner barrel and define a top wall of the combustion chamber, an outer top plate mounted on an upper portion of the outer barrel so as to close the upper portion of the outer barrel, a plurality of connection pipes arranged between the inner top plate and the outer top plate so as to communicate with the combustion chamber, and a burner mounting cylinder provided therein with a burner and arranged at a side portion of the tank body so as to extend through the inner barrel and outer barrel, to thereby introduce a flame formed at the burner into the combustion chamber. The inner barrel is formed into a thickness larger than that of the outer barrel and the inner barrel is made by subjecting a flat plate to rolling to form a cylindrical plate and then joining lateral ends of the cylindrical plate to each other. The tank structure further includes a joint ring arranged at a lower portion of the tank body and including an outer barrel joint section of a cylindrical shape joined to an inner surface of the lower portion of the outer barrel and an inner barrel joint section of a cylindrical shape joined to an inner surface of the lower portion of the inner barrel. The joint ring is formed into a thickness between the thickness of the outer barrel and that of the inner barrel. The remaining components of the tank body contacted with water are formed into a thickness substantially identical with the thickness of the outer barrel.

In a preferred embodiment of the present invention, the tank structure further includes a combustion chamber bottom plate arranged at the lower portion of the outer barrel in a manner to correspond to the outer top plate. The outer top plate and combustion chamber bottom plate each are formed on an outer periphery thereof with cylindrical sections fitted in the outer barrel. The cylindrical sections of the outer top plate and combustion chamber bottom plate each are firmly joined to the outer barrel by welding.

In a preferred embodiment of the present invention, the tank structure further includes a temperature detector arranged on the outer barrel in a manner to be positioned laterally of the connection pipes, a water supply pipe connected to a portion of the inner barrel opposite to the upper portion of the inner barrel, and a hot-water discharge pipe connected to a portion of the outer barrel right below the outer top plate. The water supply pipe is constructed so as to supply tap water directly to the tank body without any pressure reducing valve.

As described above, the present invention is so constructed that the inner barrel which is increased in thickness is formed by rounding a flat plate by rolling to form a cylindrical plate and then joining both lateral ends of the cylindrical plate to each other by welding while fabricating the main part of the tank body from a material identical with that used in the prior art. Also, the joint ring is arranged between the inner barrel and the outer barrel to firmly join both barrels to each other therethrough. Thus, the tank structure may be manufactured without requiring any specific equipment.

Also, the tank structure of the present invention exhibits strength sufficient to prevent breakage of the tank body in spite of direct application of a pressure of tap water to the tank body while increasing heat exchange efficiency.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts; wherein.

DETAILED DESCRIPTION OF THE PREFERRED EMBODIMENT

Now, a tank structure for a hot-water supply unit according to the present invention will be described hereinafter with reference to the accompanying drawings.

Figure 1:
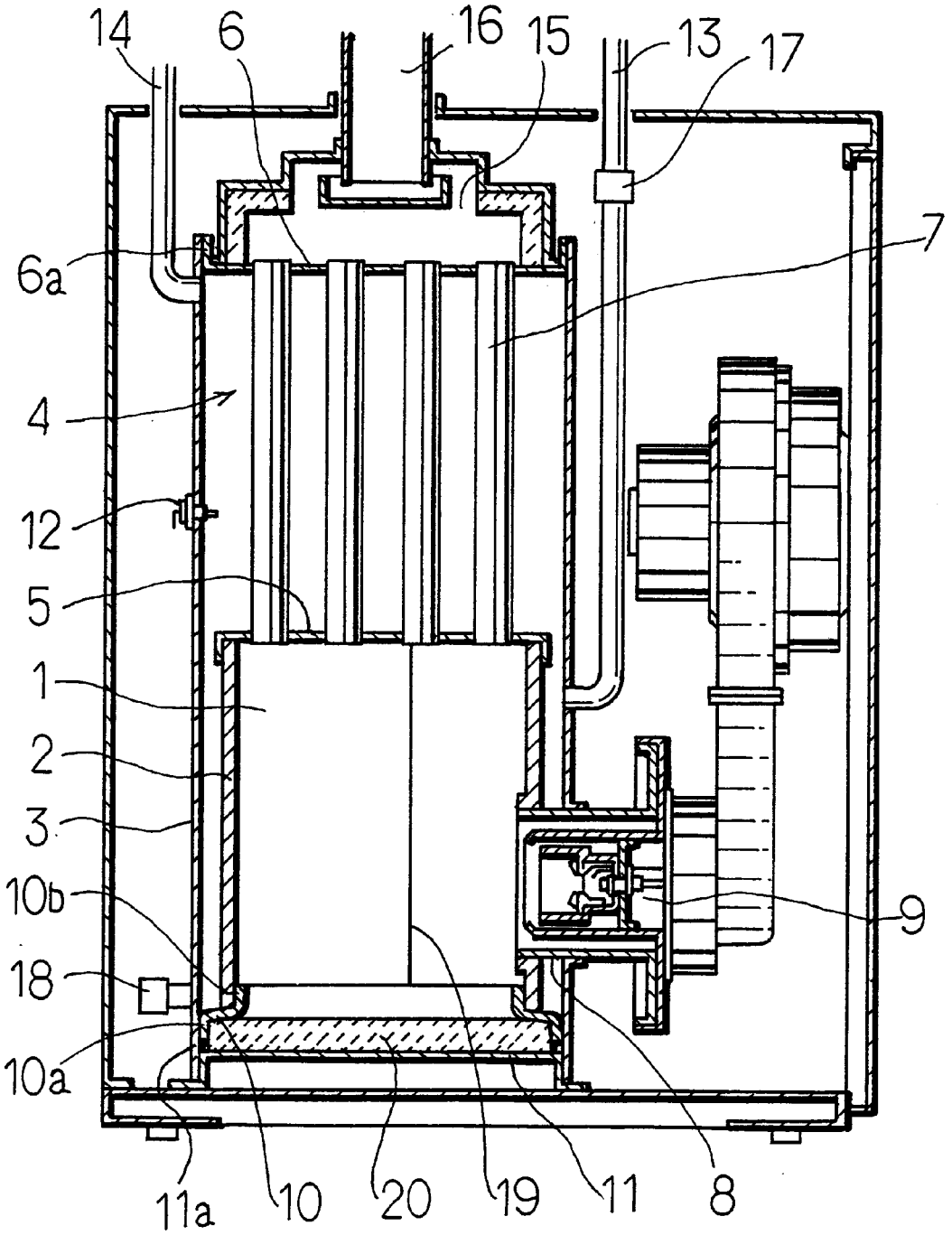
FIG. 1 is a fragmentary vertical sectional view showing an essential part of an embodiment of a tank structure for a hot-water supply unit according to the present invention.
Figure 2:
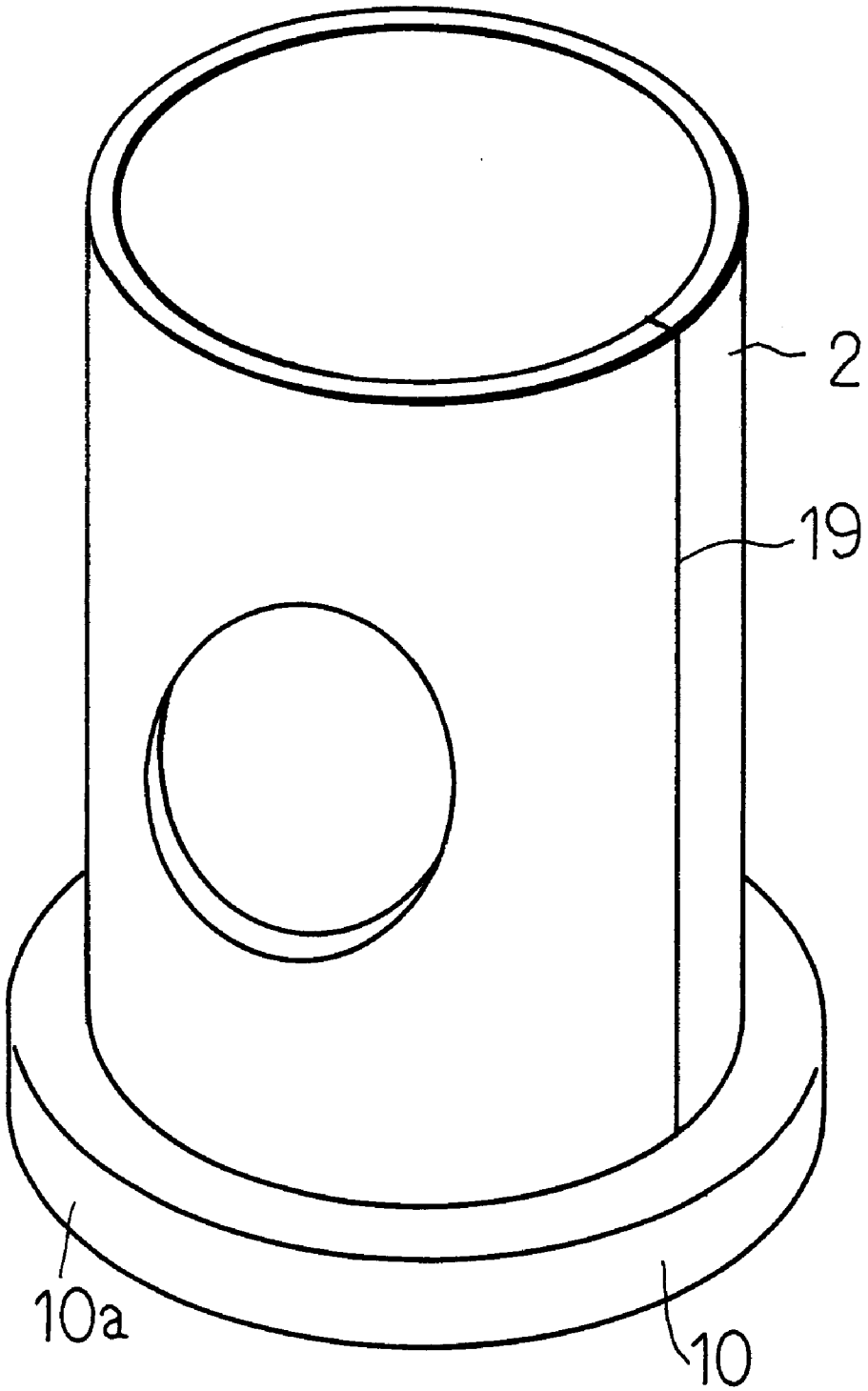
FIG. 2 is a perspective view showing an inner barrel incorporated in the tank structure of FIG. 1.

In FIGS. 1 and 2, reference numeral 1 designates a combustion chamber, 2 is an inner barrel constituting a side wall of the combustion chamber 1, and 3 is an outer barrel arranged outside the inner barrel 2 in a manner to be spaced at a predetermined interval from the inner barrel 2. Thus, the inner and outer barrels 2 and 3 cooperate with each other to provide a tank body 4 of a double-barrel structure while being joined at a lower end thereof to each other. The inner barrel 2 is mounted on an upper end thereof with an inner top plate 5 for closing the upper end of the inner barrel 2 and likewise the outer barrel 3 is fixedly mounted on an upper end thereof with an outer top plate 6, which is arranged so as to close the upper end of the outer barrel 3. Between the inner top plate 5 and the outer top plate 6 are arranged connection pipes 7. The tank body 4 is provided with a burner mounting cylinder 8, which is arranged so as to extend through the outer barrel 3 and inner barrel 2, to thereby communicate with the combustion chamber 1 defined in the inner barrel 2. The burner mounting cylinder 8 is mounted therein with a burner 9 in a manner to face the combustion chamber 1 through an opening of an inner end of the burner mounting cylinder 8, so that a flame formed by the burner may be introduced into the combustion chamber 1.

The tank structure of the illustrated embodiment also has an exhaust gas chamber 15 defined above the outer top plate 6 and includes an exhaust cylinder 16 arranged so as to communicate with the exhaust gas chamber 15. Thus, combustion gas fed from the burner 9 to the combustion chamber 1 is then guided through the connection pipes 7 to the exhaust gas chamber 14 and then exhausted through the exhaust cylinder 16 to an exterior.

The inner barrel 2 and outer barrel 3 are joined at a lower end thereof to each other through a joint ring 10 interposedly arranged therebetween as described hereinafter. Also, the outer barrel 3 is securely provided on an inside of the lower end thereof with a combustion chamber bottom plate 11.

The outer barrel 3 is mounted on an outer surface thereof with a water supply pipe 13 in a manner to communicate with an interior of the outer barrel 3. The water supply pipe 13 is arranged at an intermediate position of the outer barrel 3. The outer barrel 3 is also mounted on the outer surface thereof with a hot-water discharge pipe 14 in a manner to communicate with the interior of the outer barrel 3. The hot-water discharge pipe 14 is positioned at an upper portion of the outer barrel 3 right below the outer top plate 6. Further, the outer barrel 3 is provided on the outer surface thereof with a temperature detector 12 while being positioned laterally of the connection pipes 7 and between the water supply pipe 13 and the hot-water discharge pipe 14. The water supply pipe 13 is mounted on an intermediate portion thereof with a check valve 17 for selectively permitting supply of water to the tank body 4. Thus, when a cock (not shown) is rendered open, tap water opens the check valve 17, to thereby be fed to the tank body 4. The outer barrel 3 is provided on the lower end thereof with a lidded drainage pipe 18 in a manner to communicate with the interior of the tank body 4, so that water in the tank body may be drained away when a lid is removed from the drainage pipe as desired.

A temperature of water in the tank body 4 is detected by the temperature detector 12. When the temperature detected is below a predetermined level, the temperature detector 12 outputs a combustion command to the burner 9, water in the tank body 4 is heated to the predetermined temperature. Then, a cock for discharge (not shown) is rendered open, hot water heated in the tank body 4 is outwardly discharged through the hot-water discharge pipe 14. When cool tap water is substitutionally supplied to the tank body 4 during or after discharge of the hot-water, the temperature detector 12 detects a temperature of the water, to restart the burner 9, to thereby ensure continuous supply of hot water at a predetermined temperature. Thus, the tank structure of the illustrated embodiment permits hot water in the tank body 4 heated to a predetermined temperature to be first discharged when the cock for discharge is open, resulting in rising temperature characteristics thereof being increased. When cool tap water is supplied to the tank body 4 during or after the discharge, it is mixed with hot water remaining in the tank body 4, to thereby eliminate excessive nonuniformity in temperature of water in the tank body 4, resulting in a temperature of hot water supplied or discharged being stable.

The conventional hot-water supply unit of this type, as described above, readily exhibits stable hot-water temperature characteristics and increased heat exchange efficiency although a temperature control system incorporated therein is simplified in structure. However, the tank structure of the conventional unit has a disadvantage that direct application of a pressure of tap water thereto causes the tank body to be deformed, leading to water leakage, resulting in the unit being rendered unserviceable. Thus, the conventional unit is so constructed that the water supply pipe is provided with the pressure reducing valve to reduce a water pressure applied to the tank body. Likewise, the hot-water discharge pipe is provided with a safety valve to prevent water pressure of a level above an allowable level from being applied to the tank body. Thus, although the conventional unit can be satisfactorily applied to a hot-water space heating system, it causes a water pressure to be disadvantageously reduced when it is applied to a hot-water supply system equipped with a hot-water shower.

Also, as described above, the conventional unit necessarily requires a safety device such as the pressure reducing valve or safety valve. A reduction in pressure through the safety device requires to draw off drain. This requires a drainage system, so that a piping system around the hot-water supply unit is considerably complicated. In particular, a drainage piping restricts a space at which the hot-water supply unit is to be installed.

The hot-water supply unit of the illustrated embodiment is constructed so as to increase pressure resistance of the tank body 4 to a level sufficient to permit a metal piping to be arranged on the wall of the combustion chamber to constitute a heat exchange section, resulting facilitating installation of the hot-water supply unit and ensuring supply of hot water under a high pressure. More particularly, application of a pressure of tap water to the water supply pipe 13 causes force which tends to reduce a diameter of the inner barrel 2 to be applied to an outer surface of the inner barrel 2. However, the burner mounting cylinder 8 is arranged between the inner barrel 2 and the outer barrel 3 to prevent a variation in dimensions of the space therebetween. This causes nonuniform force to be applied to the whole inner barrel, so that breakage of the tank body 4 starts at a portion thereof to which increased force is applied.

In order to prevent such breakage of the tank body, in the illustrated embodiment, the inner barrel 2 is formed into a wall thickness larger than that of the outer barrel 3. More specifically, the illustrated embodiment may be so constructed that the outer barrel 3 is formed into a wall thickness of 1 mm, whereas the inner barrel 2 has a wall thickness of 3 mm. The inner barrel 2 may be formed by subjecting a flat plate to bending or rounding using a roll to form it into a cylindrical shape and then subjecting both lateral ends 19 of the rounded plate to TIG welding to form a cylinder. The inner top plate 5 is bent an outer edge thereof into a cylindrical shape and then put on the upper end of the inner barrel 2 thus formed. Then, an overlap between the inner top plate 5 and the inner barrel 2 is subject to MIG welding, to thereby attain joining therebetween.

The outer barrel 3, as described above, is provided at the lower end thereof with the drainage pipe 18, thus, it would be required to join the inner barrel 2 to the outer barrel 3 from a side of the inner barrel 2. However, the inner barrel 2 is too large in thickness to bend a lower end of the inner barrel 2 to join it to the outer barrel 3 using any conventional means. In order to solve the problem, the joint ring 10 briefly described above is arranged therebetween. The joint ring 10 includes a lower outer barrel joint ring section 10*a* and an upper inner barrel joint section 10*b* which are integrally formed together. The joint ring 10 is formed into a thickness defined between the thickness of the inner barrel 2 and that of the outer barrel 3. Such construction effectively eliminates a necessity of any working to the inner barrel 2 increased in thickness during Joining between the inner barrel 2 and the outer barrel 3. More specifically, supposing that the joint ring 10 is formed into a thickness of 2 mm which is between the above-described thicknesses of the inner and outer barrels 2 and 3, it may be made by pressing or burring using any conventional suitable means.

The illustrated embodiment permits a thickness of the joint ring 10 to approach the thickness of the outer barrel 3 if the inner barrel joint section 10*b* and outer barrel joint section 10*a* are increased in dimension to attain joining between the inner barrel joint section 10*b* and the inner barrel 2 by MIG welding carried out at two positions and joining between the outer barrel joint section 10*a* and the outer barrel 3 by seam welding carried out at two positions. An optimum thickness of the joint ring 10 may be determined by an experiment.

The remaining components of the tank body 4 may be formed into a thickness of about 1 mm as in the prior art. Thus, when a pressure of tap water is applied to the tank body 4, force acts on the inner top plate 5 and outer top plate 6, to thereby tend to deform the top plates 5 and 6 toward the combustion chamber and upwardly of the tank body 4, respectively. Nevertheless, in the illustrated embodiment, the connection pipes 7 are interposedly mounted between the inner top plate 5 and the outer top plate 6, to thereby effectively prevent deformation of the top plates. Suitable selection of a diameter of the connection pipes 7 and the number thereof permits the connection pipes to be made of such a material as used in the prior art while ensuring satisfactory durability thereof.

The combustion chamber bottom plate 11 briefly described above is formed into a disc like shape and provided on an outer periphery thereof with a cylindrical section 11*a*. The combustion chamber bottom plate 11 has a heat-resistant member 20 arranged on an upper surface thereof, to thereby provide a bottom of the combustion chamber 1. The combustion chamber bottom plate 11 is fixedly fitted in the lower end of the outer barrel 3 by joining the cylindrical section 11*a* to an inner surface of the lower end of the outer barrel 3 by seam welding. The outer barrel 6 is provided on an outer periphery thereof with a cylindrical section 6*a*, through which the outer barrel 6 is fixedly joinedly fitted in an upper end of the outer barrel 3.

Thus, the outer barrel 3 is joined at the upper and lower ends thereof to the outer top plate 6 and combustion chamber bottom plate 11, respectively. Such construction, when a pressure of tap water is applied to the tank body 4, prevents the upper and lower ends of the outer barrel 3 from being outwardly expanded through the welded portions beyond a diameter of the outer top plate 6 and combustion chamber bottom plate 11, to thereby eliminate breakage of the tank body 4 at the portions.

As described above, an increase in thickness of the inner barrel 2 and/or parts associated therewith effectively prevents the tank body 4 constituted of the inner barrel 2 and outer barrel 3 from being broken due to application of a water pressure thereto. This is substantially attained by making the components of the tank body 4 from the same material as used in the prior art although it is required to somewhat vary setting of the connection pipes 7 or the like. Also, this minimizes an increase in weight of the tank body 4.

In addition, an increase in the inner barrel 2 permits durability of the tank body 4 against thermal strain and the like to be increased correspondingly. In this respect, the water supply pipe 13 is connected to the body tank 4 at a position near the upper end of the inner barrel 2, so that water at a low temperature flowing through the water supply pipe 13 is supplied to the tank body 4 while cooling an outer surface of the inner barrel 2, to thereby increase heat exchange efficiency as compared with the prior art. Also, the inner barrel 2 is by tap water during water supply. However, the inner barrel 2 is formed into an increased thickness, to thereby facilitate thermal conduction therethrough, resulting in effectively prevent local heating of the inner barrel 2. This keeps the inner barrel 2 from being deformed and broken due to thermal strain.

As can be seen from the foregoing, in the present invention, the inner barrel increased in thickness is made by rounding a flat plate of a large thickness by rolling and then joining both lateral ends thereof to each other by welding. Thus, a rolling machine and a welding machine which have been conventionally commonly used in various fields may be used for manufacturing of the inner barrel.

In general, a tank body including an inner barrel and an outer barrel causes the inner barrel to be decreased in diameter and the outer barrel to be increased in diameter when a pressure of tap water is applied thereto. Whereas, in the present invention, the burner mounting cylinder is fixed on the tank body in a manner to extend through both inner and outer barrels to prevent a variation in dimensions of the gap between both barrels. Such construction keeps force from being uniformly applied to the whole circumference of the inner barrel, so that deformation of the inner barrel is started at a portion of the inner barrel to which force of a high level is applied. In order to avoid such a problem, the inner barrel is increased in thickness. Thus, the present invention realizes the tank structure including the tank body constituted of the inner barrel and outer barrel which is serviceable while keeping a pressure of tap water applied directly to the tank body.

In general, in a tank structure for a hot-water supply unit, an inner barrel provides a peripheral wall of a combustion chamber, so that a drainage pipe is connected to an outer barrel of a tank body. Thus, the inner barrel is outwardly enlarged at a lower end thereof to form a flare, through which the inner barrel is joined to the outer barrel. However, an equipment for enlarging the lower end of the inner barrel increased in thickness must be constructed in a specific manner, resulting in fabrication of the inner barrel being substantially impractical. In order to solve the problem, in the present invention, both barrels are joined together through the joint ring provided separately therefrom. Also, the joint ring is formed into a thickness defined between the thickness of the inner barrel and that of the outer barrel, resulting in being manufactured by pressing or burring using any suitable equipment conventionally used.

Further, in the present invention, the connection pipes are arranged between the inner top plate and the outer top plate, to thereby prevent deformation of the top plates due to direct application of a pressure of tap water thereto. Also, the connection pipes have force applied thereto in a direction of reducing a diameter thereof. However, the force is uniformly applied to a whole circumference of each of the pipes, so that the connection pipes may exhibit sufficient durability.

The conventional tank structure, when the water supply pipe is connected to the outer barrel, often encounters a trouble that water supplied through the water supply pipe to the tank body rapidly cools the inner barrel, resulting in the inner barrel being punctured due to thermal strain. On the contrary, in the present invention, the inner barrel is formed into an increased thickness to a degree sufficient to permit cooling of the inner barrel by water to be rapidly diffused around by thermal transfer, to thereby eliminate the problem.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A tank structure for a hot-water supply unit, comprising:

an inner barrel arranged so as to define a side wall of a combustion chamber;

an outer barrel arranged outside said inner barrel so as to be spaced from said inner barrel at a predetermined interval;

said inner barrel and outer barrel cooperating with each other to constitute a tank body of a double-barrel structure;

an inner top plate mounted on an upper portion of said inner barrel so as to close said upper portion of said inner barrel and define a top wall of said combustion chamber;

an outer top plate mounted on an upper portion of said outer barrel so as to close said upper portion of said outer barrel;

a plurality of connection pipes arranged between said inner top plate and said outer top plate so as to communicate with said combustion chamber;

a burner mounting cylinder provided therein with a burner and arranged at a side portion of said tank body so as to extend through said inner barrel and outer barrel, to thereby introduce a flame formed at said burner into said combustion chamber;

said inner barrel being formed into a thickness larger than that of said outer barrel;

said inner barrel being made by subjecting a flat plate to rolling to form a cylindrical plate and then joining lateral ends of said cylindrical plate to each other; and a joint ring arranged at a lower portion of said tank body and including an outer barrel joint section of a cylindrical shape joined to an inner surface of the lower portion of said outer barrel and an inner barrel joint section of a cylindrical shape joined to an inner surface of the lower portion of said inner barrel;

said joint ring being formed into a thickness between the thickness of said outer barrel and that of said inner barrel;

the remaining components of said tank body contacted with water being formed into a thickness substantially identical with the thickness of said outer barrel.

2. A tank structure as defined in claim 1, further comprising a combustion chamber bottom plate arranged at the lower portion of said outer barrel in a manner to correspond to said outer top plate;

said outer top plate and combustion chamber bottom plate each being formed with an outer periphery thereof with cylindrical sections fitted in said outer barrel;

said cylindrical sections of said outer top plate and combustion chamber bottom plate being firmly joined to said outer barrel by welding.

3. A tank structure as defined in claim 1, further comprising:

a temperature detector arranged on said outer barrel in a manner to be positioned laterally of said connection pipes;

a water supply pipe connected to a portion of said inner barrel opposite to the upper portion of said inner barrel; and a hot-water discharge pipe connected to a portion of said outer barrel right below said outer top plate;

said water supply pipe being constructed so as to supply tap water directly to said tank body without any pressure reducing valve.

* * * * *